United States Patent [19]

Tanaka et al.

[11] Patent Number: 4,573,184

[45] Date of Patent: Feb. 25, 1986

[54] HEATING CIRCUIT FOR A FILAMENT OF AN X-RAY TUBE

[75] Inventors: Shigeru Tanaka, Ootawara; Toshihiro Onodera, Kunitachi, both of Japan

[73] Assignee: Kabushiki Kaisha Toshiba, Japan

[21] Appl. No.: 655,073

[22] Filed: Sep. 26, 1984

[30] Foreign Application Priority Data

Sep. 27, 1983 [JP] Japan ..... 58-179804

[51] Int. Cl.[4] ..... H05G 1/34

[52] U.S. Cl. ..... 378/110; 378/105

[58] Field of Search ..... 378/110, 109, 105, 106

[56] References Cited

U.S. PATENT DOCUMENTS

| | | | |
|---|---|---|---|
| 4,253,048 | 2/1981 | Osako | 378/110 |
| 4,450,577 | 5/1984 | Sato | 378/110 |
| 4,520,494 | 5/1985 | Auta | 378/110 |

*Primary Examiner*—Craig E. Church

*Attorney, Agent, or Firm*—Finnegan, Henderson, Farabow, Garrett & Dunner

[57] ABSTRACT

The dissipation of the filament power of an X-ray tube is controlled by a heating circuit including a voltage resonance type DC-to-DC converter and a filament current detector/controller. The DC-to-DC converter is comprised of a switch, a capacitor, a damper diode and a transformer. These circuit elements constitute a voltage resonance type switch. A DC voltage is interrupted and applied to the primary winding of the transformer. The AC voltage is induced to the secondary winding of the transformer, thereby heating the filament of the X-ray tube. In accordance with the load curve of the X-ray tube, the filament heating voltage can be controlled within a control range defined by the resonant conditions of the switch.

13 Claims, 7 Drawing Figures

FIG. 2A
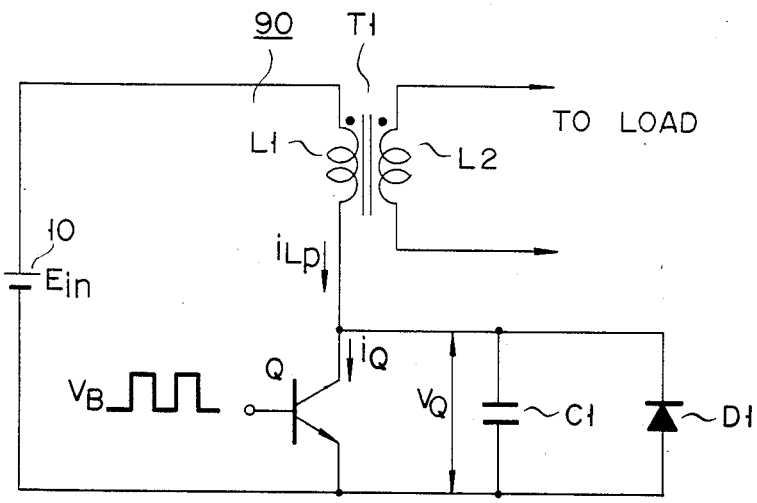
FIG. 2B
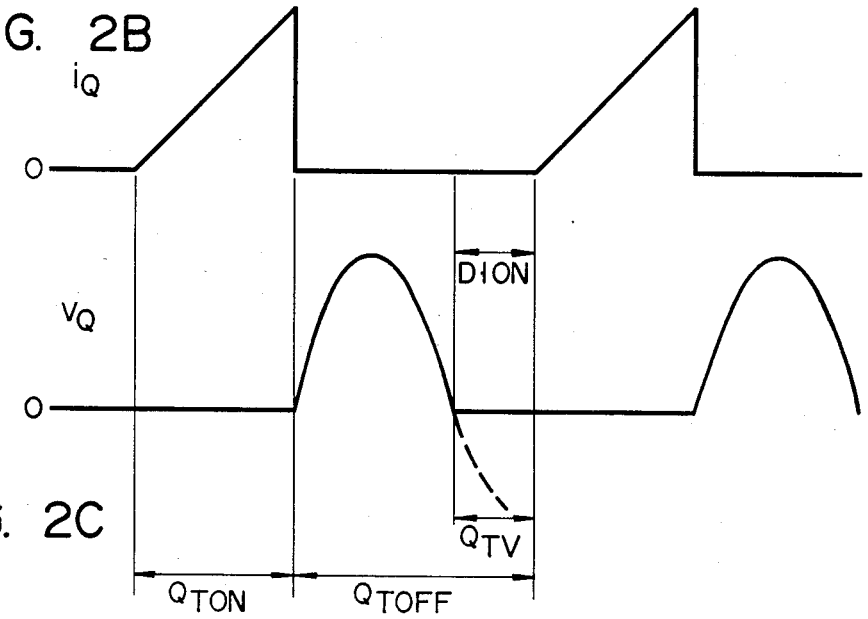
FIG. 2C

FIG. 4
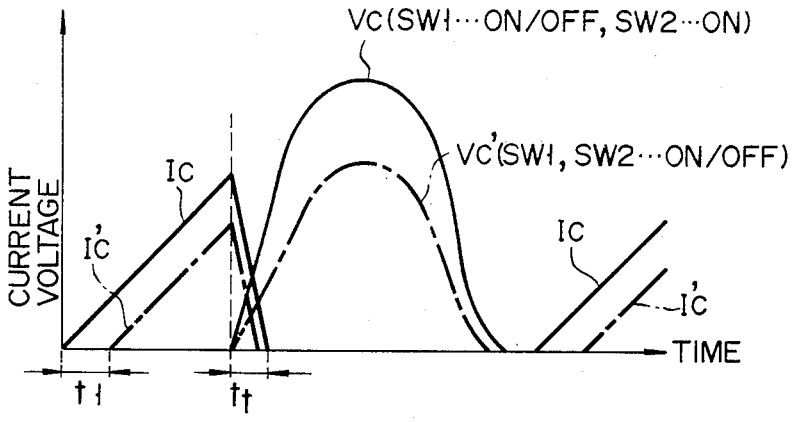
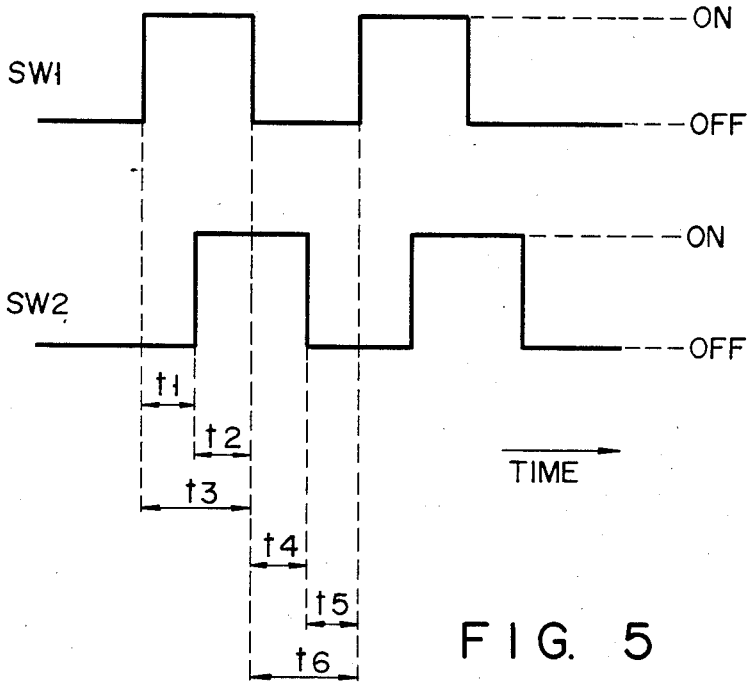
FIG. 5

HEATING CIRCUIT FOR A FILAMENT OF AN X-RAY TUBE

BACKGROUND OF THE INVENTION

1. Field of the Invention:

The present invention generally relates to a heating circuit for a filament of an X-ray tube, and more particularly, to the filament heating circuit utilizing a voltage resonance type DC-to-DC converter.

2. Description of the Prior Art:

In an X-ray diagnostic apparatus, such as an X-ray computerized tomographic (CT) apparatus or a digital fluoroscopic apparatus, the most important aspect is to realize a stable X-ray generation. It is therefore necessary to stabilize the application of high voltage to an anode of an X-ray tube, and also to heat (power supply) a filament (cathode) of the X-ray tube.

Various types of filament heating circuits have been proposed. For instance, according to a first conventional heating circuit, a ferroresonant stabilizer is used in combination with series-connected resistors, whereby the voltage of the primary circuit of a transformer is controlled to be stable by utilizing the voltage drop across the resistors. This conventional heating circuit has the following drawbacks. That is, the response speed of the filament heating is considerably low because it is restricted by the frequency of the power supply, i.e., 50 HZ or 60 HZ. Secondly, due to the inherent matter of the circuit arrangement, a stable heating cannot be substantially realized when the equivalent resistance of the filament changes during operations. This resistance includes not only the filament resistance per se, but also an internal resistance of the high voltage cables through which high voltage is applied to the X-ray tube. Moreover, if a rectifier diode bridge circuit and a smoothing capacitor are employed in the secondary winding circuit of the transformer, an AC current flowing through the primary winding is disturbed to a great extent during the discharge period of the capacitor. This causes the primary voltage of the transformer to be astable because of the characteristic of the ferroresonant stabilizer.

The switching regulator type filament heating circuit has been also proposed. According to this heating circuit, a limitation exists in the switching frequency, e.g., 100 to 200 HZ. If a higher switching frequency is selected for such a heating circuit, a greater loss of the power transmission in the transformer may occur. This is caused by a leakage inductance between the primary and secondary windings of the transformer.

SUMMARY OF THE INVENTION

An object of the present invention is to provide a stable filament heating circuit.

Another object is to realize a fast response of the filament heating.

Further, another object is to improve an efficiency of the power transmission in the filament heating circuit.

Still, a further object is a provide a compact and light-weighted filament heating circuit.

These objects and other features may be accomplished by providing a heating circuit for a filament of an X-ray tube, comprising a transformer having at least a primary winding coupled to a DC source and a secondary winding coupled to the filament of the X-ray tube; a switching device, connected between the primary winding of the transformer and the DC source, having at least a capacitor and a diode functioning as a damper diode connected parallel to the capacitor and the switching device, the switching device constituting a voltage resonance type switch in conjunction with at least the capacitor and the primary winding whereby the DC voltage from the DC source is interrupted and thus an AC voltage having an arc waveform is induced at the secondary winding; a detector coupled to the filament of the X-ray tube, for detecting a filament current to produce a switching control signal; and a switch drive device for driving the switching device by controlling at least one of a switching period and a conducting period thereof with remaining a resonant condition of the voltage resonance type switch so as to vary the filament current.

BRIEF DESCRIPTION OF THE DRAWINGS

The invention is best understood with reference to the accompanying drawings, in which.

FIG. 2A shows a circuit diagram of a voltage resonance type DC-to-DC converter, and FIGS. 2B and 2C are waveform charts of switching voltage and current, respectively;

FIG. 4 is a waveform chart of switching voltages and currents of the heating circuit shown in FIG. 3; and FIG. 5 is a timing chart of first and second switches of the heating circuit shown in FIG. 3.

DETAILED DESCRIPTION OF THE PREFERRED EMBODIMENTS

Figure 1:
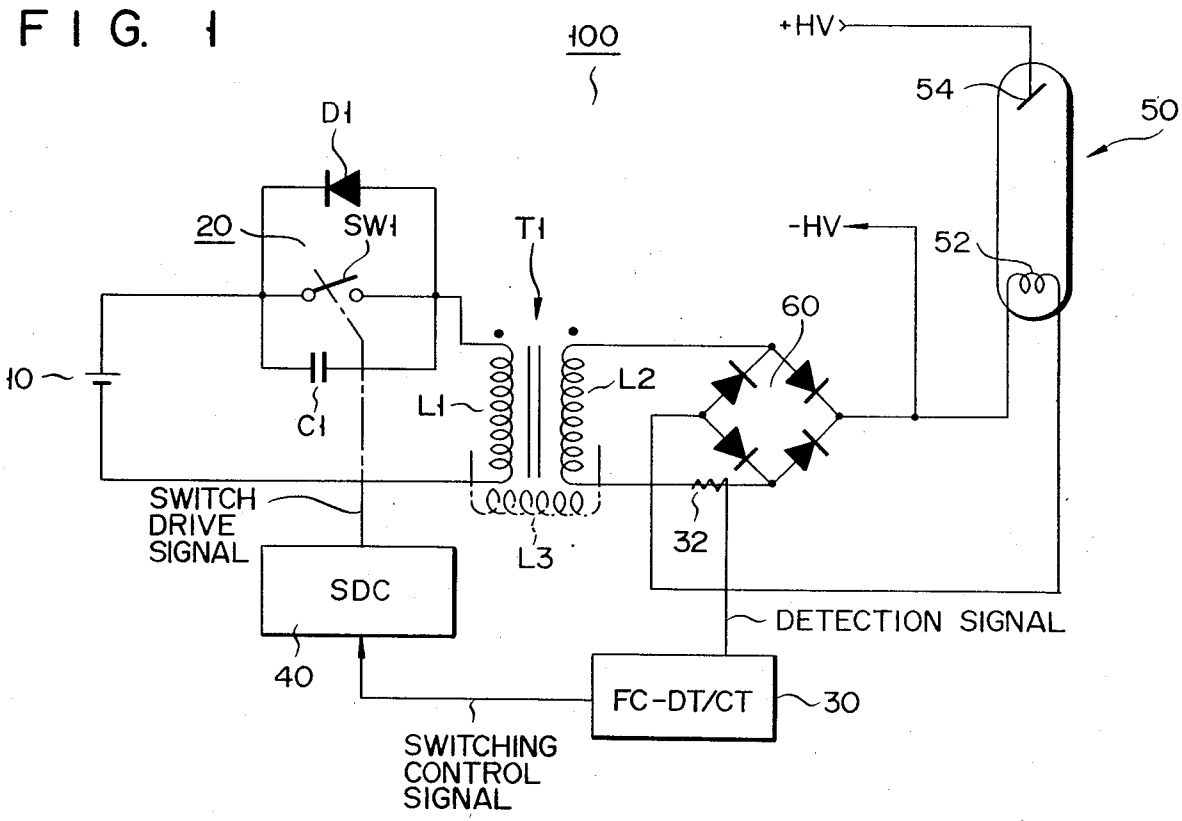
FIG. 1 shows a schematic circuit diagram of a filament heating circuit according to a first preferred embodiment of the invention.

In FIG. 1, a heating circuit for a filament of an X-ray tube 100 is shown as a first preferred embodiment. This heating circuit 100 is mainly constructed by a DC source 10, a voltage resonance type DC-to-DC converter 20, and a filament current detector/controller 30. The voltage resonance type DC-to-DC converter 20 essentially includes a switching element, a capacitor, a damper diode and a transformer. The capacitor and the transformer constitute a resonant circuit (will be described in more detail later).

In FIG. 1, a primary winding L1 of a transformer T1 is connected to a DC source 10 through a switch SW1 and a parallel arrangement of a capacitor C1 and a damper diode D1. The switch SW1 may be constructed by a bipolar transistor, a unipolar transistor, or a gate-turn-off thyristor and so on. A combination of this switch SW1, the capacitor C1 and the transformer T constitutes a so-called "a voltage resonance type single-ended switch circuit". The switch SW1 is driven by a switch drive circuit 40. A filament current detector/-controller 30 is coupled via a current sensor 32 to a secondary winding L2 of the transformer T1. The current sensor 32 may be constructed by a current transformer, or a Hall-effect element and so on. A filament (cathode) 52 of an X-ray tube 50 is also connected via a rectifier bridge circuit 60 to the secondary winding L2. This filament 52 is connected to a negative terminal of a high voltage source (not shown), and an anode 54 is connected to a positive terminal of the high voltage source. The filament current detector/controller 30 is connected to the switch drive circuit 40. The leakage inductance of the transformer T1 is denoted by "L3".

Before describing the operations of the first heating circuit 100 according to the invention, the basic construction and operation of the known voltage resonance type DC-to-DC converter 90 will be explained with reference to FIG. 2. It is noted that the circuit elements shown in FIG. 2A are indicated by the same numerals employed in FIG. 1.

In this DC-to-DC converter 90, a transistor Q functions as the switch SW1 as shown in FIG. 1 (will be referred to as "a switch Q").

In the DC-to-DC converter 90, when the switch Q is turned on (conductive), a current iQ flows through the exciting inductance of the transformer T1. A waveform of this current represents a straight line as shown in FIG. 2B.

When the switch Q is turned off (non-conductive), the current which has been stored in the exciting inductance begins to flow into the capacitor C1. Accordingly, the voltage $V_Q$ across the switch Q increases, reaches its maximum value, and thereafter returns to a zero volt. The waveform of this voltage $V_Q$ has an arc shape as shown in FIG. 2C. During this voltage changing period ($Q_{TOFF}$–$Q_{TV}$) the power transmission is carried out from the primary winding L1 of the transformer T1 to the secondary winding L2 thereof. After this period, the voltage $V_Q$ will be further reduced below the zero volt unless the damper diode D1 is connected parallel to the switch Q as well as the capacitor C1 (a period "$Q_{TV}$"). Since this damper diode D1 is forward biased, the voltage $V_Q$ remains at nearly zero. During this $Q_{TV}$ period, the energy stored in the exciting inductance returns to the input terminal.

While the damper diode D1 becomes conductive, the next period will commence. That is to say, when the switch Q is again turned on, the voltage $V_Q$ across the switch Q is still zero. As a result, the transition power loss occuring when the switch Q is turned on can be reduced to zero in principle. On the other hand, even if the current iQ still remains when the switch Q is turned off, the transmission power loss can be considerably diminished because the voltage VQ increases slowly.

As will be described later, in the heating circuit 100 according to the invention, the transistor Q is controlled in such a way that the base drive voltage "$V_B$" is amplitude-modulated, or frequency-modulated based upon the detection signal that is obtained by the filament current detector/controller 30. The detector/controller 30 is provided with the current sensor for detecting the filament current of the X-ray tube. In one preferred embodiment, while the conducting period of the transistor Q, i.e., the period "$Q_{TON}$" is kept constant, the switching period of the transistor Q can be controlled under the above-mentioned voltage resonant condition (i.e., the switching frequency). As a result, the variable switching-period range "$Q_{TV}$" of the transistor Q corresponds to the period $D_{1ON}$ during which the damper diode D1 is turned on. That is, since the switching period of the transistor Q varies within the period "$Q_{TV}$", the power transmission to the load (the filament of the X-ray tube) can be controlled. Consequently, in response to the detected filament current, the transmission power of the DC-to-DC converter 90 can be controlled within the predetermined period "$Q_{TV}$" according to the invention. This period "$Q_{TV}$" is determined by the voltage resonant condition of the DC-to-DC converter 90.

A description will now be made of the entire operation of the heating circuit 100.

In FIG. 1, when the switch SW1 is driven by the switch drive circuit 40 at a given switching period, the primary winding L1 of the transformer T1 is excited by an interrupted DC voltage derived from the DC source 10. A given voltage is induced in the secondary winding L2 of the transformer T1. This induced voltage is applied to the filament 52 of the X-ray tube 50 after being rectified by the rectifier bridge circuit 60. The filament current is detected via the current sensor 32 by the filament current detector/controller 30.

As is known in the art, it is necessary to vary the so-termed "mAs value" of the X-ray tube (i.e., a tube current is multiplied by an exposure time) in accordance with the load characteristic of the X-ray tube. That is, the "mAs value" should be controlled in accordance with the load characteristic curve of the X-ray tube so as to realize a sharp X-ray image. Moreover, as previously described, since the equivalent filament resistance will change during the operation, controlling this value is also needed.

In accordance with the detection signal of the filament current, the filament current detector/controller 30 produces a switching control signal. This signal is supplied to the switch drive circuit 40. In the drive circuit 40, a switch drive voltage $V_B$ is produced based upon the switching control signal by way of, for instance, a pulse width modulation or a pulse frequency modulation.

Figure 3:
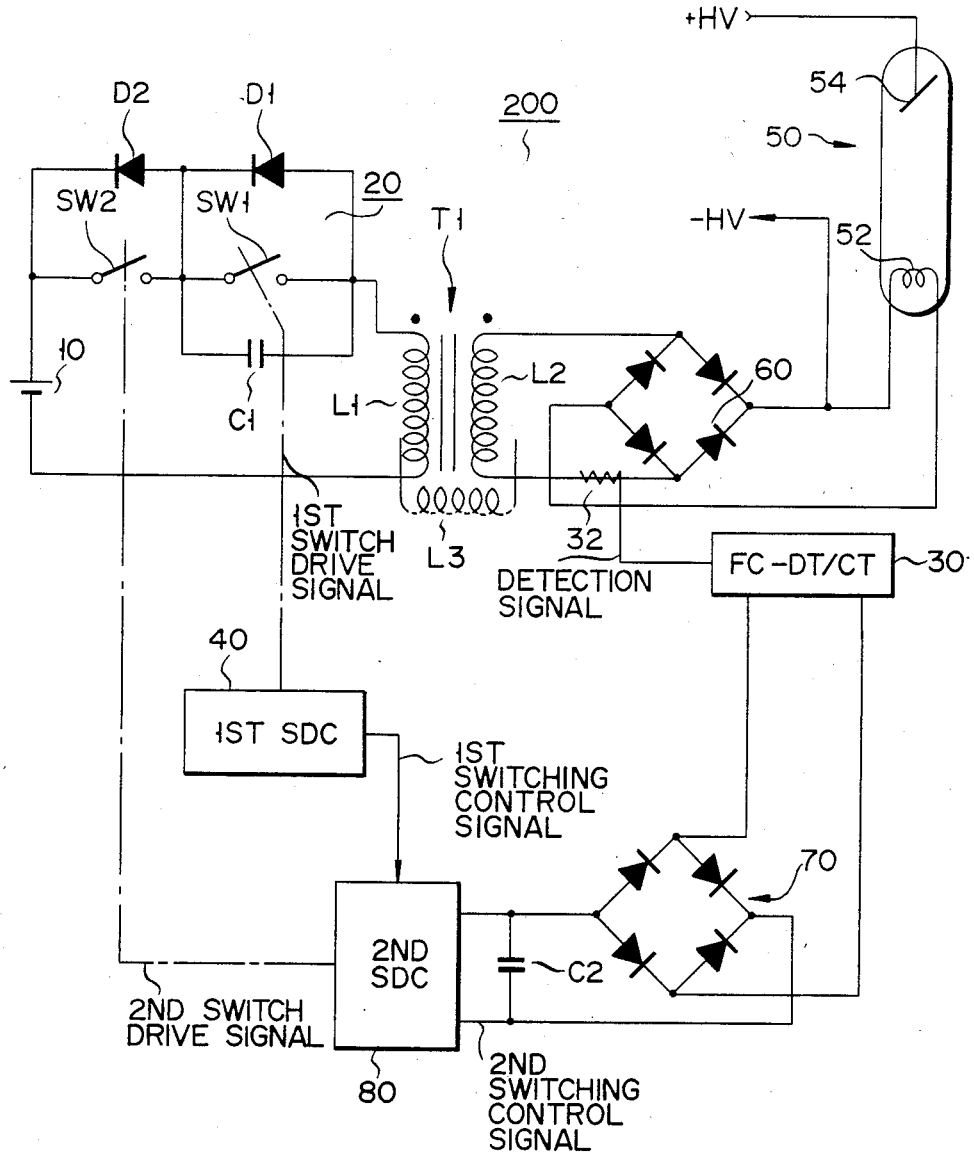
FIG. 3 shows a circuit diagram of a filament heating circuit according to a second preferred embodiment.

In FIG. 3, a second filament heating circuit 200 according to the invention is shown. As obviously seen from this circuit, the same, or similar circuit elements are indicated by the same numerals and symbols employed in FIG. 1.

In addition to the basic circuit 100 shown in FIG. 1, the following circuits are combined. That is, a second switch SW2 as an auxiliary switch is series-connected to the first switch SW1 as a main switch. Another diode D2 is connected parallel to the second switch SW2. The filament current detector/controller 30 produces a second switching control signal by receiving the detection signal of the filament current through the current sensor 32. This switching control signal is rectified by a rectifier bridge circuit 70. The rectified switching control signal is then filtered by a filter capacitor C2. The filtered switching control signal is supplied to a second switch drive circuit 80. On the other hand, the first switch drive circuit 40 for driving the first switch SW1 includes a timing pulse oscillator (not shown in detail). The timing pulse oscillator automatically produces timing pulse signals as the first switching control signal, thereby controlling the switching timings of the first switch SW1, i.e., the duty cycle or the switching frequency. The first switching control signal derived from the first switch drive circuit 40 and the second switching control signal derived from the filament current detector/controller 30 are supplied to the second switch drive circuit 80, so that the drive timing of the second switch SW2 is controlled (will be described in more detail later).

As easily seen from the circuit 200, a feedback path for the second switch drive circuit 90 is formed by the current sensor 32, the filament current detector/controller 30, the rectifier bridge circuit 70 and the filter capacitor C2.

Referring to FIGS. 3, 4 and 5, an operation of the second heating circuit 200 will now be explained.

In the heating circuit 200 shown in FIG. 3, the following description will be made of the case where the second switch SW2 is kept ON (conductive) in a given time period. Switching the first switch SW1 by the first switch drive circuit 40 can apply an interrupted DC voltage to the primary winding L1 of the transformer T1. The DC voltage is derived from the DC source 10. The symbols Vc, Vc', Ic, and Ic' shown in FIG. 4 indicate a voltage across the first switch SW1 and a current flowing through the switch SW1, and correspond to "$V_Q$" and "iQ" shown in FIG. 2, respectively. When the interrupted DC voltage is applied to the primary winding L1, a given AC voltage is induced to the secondary winding L2. The induced AC voltage is rectified via the current sensor 32 by the first diode rectifier bridge circuit 60 (referred to as "a first rectifier circuit"). The rectified voltage is then applied to the filament 52 of the X-ray tube 50 so as to heat it.

On the other hand, the current flowing through the filament 52 is detected via the current sensor 32 by the filament current detector/controller 30. The detection signal of the detector/controller 30 is rectified by the second diode rectifier bridge circuit 70 (referred to as "a second rectifier circuit"), and is filtered by the capacitor C2 and is then supplied as the second switching control signal to the second switch drive circuit 80. A function of the second switch drive circuit 80 is to control the switching operation of the second switch SW2 based upon this second switching control signal and also the first switching control signal derived from the first switch drive circuit 40.

Next, the correlation of the switching operations between the first and second switches SW1 and SW2 will now be described. For instance, referring to FIG. 5, the switching timing of the second switch SW2 is delayed with respect to that of the first switch SW1 by a time period "t1". In this case, although the turn-on duration time of the first switch SW1 is defined by "t3", a time period "t2" during which the current "Ic'" flows through the first switch SW1 is shorter than the turn-on duration time "t3" (t2=t3−t1). Accordingly, a value of the current "Ic'" flowing through the first switch SW1 becomes smaller than that of the current "Ic" as shown in FIG. 4. The latter current "Ic" flows through the first switch SW1 while the second switch SW2 remains ON (conductive).

Similarly, the turn-off duration time of the first switch SW1 is equal to a time period "t6". However, a time period "t4" during which the voltage appears on the first switch SW1 is shorter than the time period "t6" (t4=t6−t5). This voltage corresponds to that caused by the counter electromotive force of the transformer T1. Such a shorter time period "t4" is understood that a charging time of the capacitor C1 becomes short. As a result, the voltage "Vc'" across the first switch SW1 has a lower value than that of the second switch SW2 which is being turned ON (conductive).

Under the above-described operations the following filament control operation can be established. The switching timing of the second switch (auxiliary switch) SW2 with respect to the first switch (main switch) SW1 is controlled in response to a variation of the filament current, i.e., the first and second switching control signals, so that the power dissipation of the filament 52 can be controlled. In other words, feed-back control can be established to heat the filament 52.

It should be noted that only the ON/OFF timings of the auxiliary switch SW2 can be controlled without changing the duty ratio of the switchings of SW1 and SW2, because the resonant condition of the heating circuit 100 must be maintained.

A detailed description of this filament power control will now be made with reference to FIGS. 3, 4 and 5. The current (Ic, or Ic') flowing through the first switch SW1 is equal to that flowing through the primary winding L1 of the transformer T1. The voltage (Vc, or Vc') across the first switch SW1 is equal to that across the primary winding L1, i.e., the capacitor C1. Consequently, the switching operation of the second switch SW2 is controlled through the second switch drive circuit 80 in response to the variations of the filament current. That is, the filament current is controlled to be stable by the feed-back control, with the result that stable heating of the filament can be realized.

As seen from the timing chart of the switches SW1 and SW2 shown in FIG. 5 and also the waveform chart of the switching voltage and current, the ON-timing of the second switch SW2 is shifted with respect to that of the first switch SW1, so that the voltage induced between the primary winding L1 of the transformer T1 can be varied from Vc to Vc'. As a result, the filament power control can be realized. That is, the power dissipation of the filament 52 of the X-ray tube 50 can be controlled by changing the ON-timing of the second switch SW2.

According to the second heating circuit 200, a controllable range of the filament power control can be wider than that of the first heating circuit 100, since the auxiliary switch SW2 is additionally connected to the main switch SW1 so as to prevent the capacitor C1 from being charged.

In accordance with the invention, the primary winding circuit of the transformer T1 including the first and second switches SW1 and SW2, and the capacitor C1 is constructed as the voltage resonance type single-ended switch circuit 20, so that a quick response of the filament heating can be achieved and also the transformer T1 can be made more compact.

A detailed reason will now be explained. The waveform of the voltage Vc, or Vc' across the first switch SW1 (namely, the voltage appearing on the capacitor C1 upon the first switch SW1 being nonconductive) has an arc shape as shown in FIG. 4 due to the resonant phenomenon. This results in the lower transistion power loss of the switches. That is to say, the time period "$t_f$" can be extremely shortened as compared with that of the conventional switching transition. Moreover, although there is a leakage inductance L3 in the transformer T1, the power transmission can be realized, because the energy stored in the leakage inductance L3 is discharged to the load (the filament) when the first switch SW1 is non-conductive (OFF). As the voltage resonance type single-ended switch circuit 20 is employed, the high switching frequency of the switches can be achieved. Consequently, the filament heating response can be improved and the compact transformer can be employed.

According to an experiment using the second heating circuit 200, the switching frequency was selected to be 10 KHZ, the DC voltage of the DC source 10 was 100 V, and the heating voltage of the filament was several ten volts. This heating circuit was applied to the dual energy type CT apparatus in which the low anode voltage (approx. 80 KV)-high anode current (approx. 200 mA) X-ray pulse and the high anode voltage (approx. 120 KV)-low anode current (approx. 100 mA) X-ray pulse are alternately produced within the short time interval.

While the invention has been explained with respect to the specific embodiments, the technical scope and spirit of the present invention are not restricted thereto. Various types of the modifications and omissions can be conceived by those skilled in the art without departing from the scope of the invention.

For example, in the previous embodiments, the feedback control was based upon the variations of the filament current. It is also possible for the filament power control to detect not only the filament current, but also the tube current (i.e., the anode current).

A current sensor may be formed by a resistor having a smaller resistance than that of the filament, or of the high voltage cables. That is, a voltage appearing on the small resistance resistor by the cathode current may be applied to the filament current detector/controller 30 as the detection signal. As is known in this technical field, an electrical insulation of the resistor against the high voltage circuit of the X-ray tube is required. Generally speaking, all of detectors for detecting variations in the cathode current can be utilized as the filament current detector/controller 30. Since the functions of the second rectifier circuit 70 and the filter capacitor C2 are to remove the RF ripple components from the second switching control signal so as to derive a DC switching control signal, those circuit elements may be omitted if the second switching control signal has little RF ripple component.

The filament may be heated by an AC voltage induced at the secondary winding L2 of the transformer T1. In this case, the first rectifier circuit 60 may be omitted.

The feedback path may be constructed by a variable resistor and a driver for changing the resistance of the variable resistor. In other words, an analogue signal is output from the second switch drive circuit 80 in response to the variations in the second switching control signal. Further, variable resistance means whose resistance changes in response to the analogue signal may be employed as the second switch SW2. Then the same feedback effect can be realized in the above circuit arrangement. It should be noted that the second switch drive circuit is operable without giving any electrical influence to the first switch drive circuit.

As has been described in detail, the primary winding of the transformer is excited by the RF voltage generated in the voltage resonance type single-ended switch circuit according to the invention. The filament of the X-ray tube can be heated by the RF voltage. A quick heating response for the filament can be realized. Power transmission can be acheived in spite of the provision of leakage inductance. Although there is a risk that an overcurrent flows through the filament circuit at the beginning of the filament heating, the heating circuit according to the invention can be operated in a stable condition because the leakage inductance can avoid the overcurrent. As a result, a compact transformer can be employed, so that the entire circuit can be made small and light. The stable filament heating can be realized by utilizing the filament current feed-back control, with the result that the tube current of the X-ray tube can be stabilized.

What is claimed is:

1. A heating circuit for a filament of an X-ray tube comprising:

transformer means having at least a primary winding coupled to a DC source and a secondary winding coupled to the filament of the X-ray tube;

switching means, connected between the primary winding of the transformer means and the DC source, having at least a capacitor and a diode functioning as a damper diode, connected parallel to the capacitor and the switching means, the switching means constituting a voltage resonance type switch in conjunction with at least the capacitor and the primary winding, whereby a DC voltage of the DC source is interrupted and thus an AC voltage having an arc waveform is induced at the secondary winding;

detection means, coupled to the filament of the X-ray tube, for detecting a filament current to produce a switching control signal; and means for driving the switching means by controlling at least one of a switching period and a conducting period thereof while retaining a resonant condition of the voltage resonance type switch so as to vary the filament current.

2. A circuit as claimed in claim 1, further comprising a diode rectifier bridge circuit connected between the secondary winding and the filament so as to rectify the AC voltage induced at the secondary winding.

3. A circuit as claimed in claim 1, wherein the detection means includes a current sensor coupled to the filament and a filament current detector/controller, the current sensor being constructed by a current transformer.

4. A circuit as claimed in claim 1, wherein the detection means includes a current sensor coupled to the filament and a filament current detector/controller, the current sensor being constructed by a Hall-effect element.

5. A circuit as claimed in claim 1, wherein the voltage resonance type switch is a transistor.

6. A circuit as claimed in claim 1, wherein the voltage resonance type switch is a thyristor.

7. A heating circuit for a filament of an X-ray tube comprising:

transformer means having at least a primary winding coupled to a DC source and a secondary winding coupled to the filament of the X-ray tube;

first switching means, connected between the primary winding of the transformer means and the DC source, having at least a capacitor and a first diode functioning as a damper diode, connected parallel to the capacitor and the first switching means, the first switching means constituting a voltage resonance type swtich in conjunction with at least the capacitor and the primary winding, whereby a DC voltage of the DC source is interrupted and thus an AC voltage having an arc waveform is induced at the secondary winding;

second switching means, series-connected to the first switching means, having a second diode connected parallel to the second switching means;

first driving means having an oscillator that produces a first switching control signal, for driving the first switching means based upon the first switching control signal by controlling at least one of a switching period and a conducting period of the first switching means while retaining a resonant condition of the voltage resonance type switch;

detection means, coupled to the filament of the X-ray tube, for detecting a filament current to produce a second switching control signal; and second driving means for driving the second switching means based upon the first and second switching control signals so as to vary the filament current.

8. A circuit as claimed in claim 7, further comprising a diode rectifier bridge circuit connected between the secondary winding and the filament so as to rectify the AC voltage induced at the secondary winding.

9. A circuit as claimed in claim 7, further comprising a filtering capacitor and a diode rectifier bridge circuit connected between the filament current detection means and the second driving means so as to remove RF ripple components contained in the second switching control signal.

10. A circuit as claimed in claim 7, wherein the detection means includes a current sensor coupled to the filament and a filament current detector/controller, the current sensor being constructed by a current transformer.

11. A circuit as claimed in claim 7, wherein the detection means includes a current sensor coupled to the filament and a filament current detector/controller, the current sensor being constructed by a Hall-effect element.

12. A circuit as claimed in claim 7, wherein the voltage resonance type switch is a transistor.

13. A circuit as claimed in claim 7, wherein the voltage resonance type switch is a thyristor.

* * * * *